US005916615A

United States Patent [19]

Brady et al.

[11] Patent Number: 5,916,615

[45] Date of Patent: Jun. 29, 1999

[54] CASE-READY PACKAGES HAVING SMOOTH, GAS-PERMEABLE SUBSTRATES ON THE BOTTOMS THEREOF TO REDUCE OR PREVENT DISCOLORATION WHEN PLACED IN A STACK

[75] Inventors: Sean A. Brady, Greer; Robin H. Logan, Moore; D. Chris Noel, Greer; H. Walker Stockley, III, Spartanburg, all of S.C.

[73] Assignee: W. R. Grace & Co.-Conn., Duncan, S.C.

[21] Appl. No.: 08/878,386

[22] Filed: Jun. 18, 1997

[51] Int. Cl.[6] ..... A21D 10/02; A23B 55/00; B65D 1/34; B65D 43/02

[52] U.S. Cl. ..... 426/129; 426/127; 426/396; 426/415; 428/35.7; 428/36.6; 428/515; 206/557; 229/123.1

[58] Field of Search ..... 428/35.7, 36.6, 428/515, 66.3; 426/392, 394, 396, 410, 411, 108, 127, 129, 415; 206/497, 503, 557, 524.3; 229/123.1

[56] References Cited

U.S. PATENT DOCUMENTS

| | | | |
|---|---|---|---|
| 2,623,826 | 12/1952 | Grinstead | 99/174 |
| 2,814,381 | 11/1957 | Stevick | 206/45 |
| 2,925,346 | 2/1960 | Harper et al. | 99/174 |
| 3,019,573 | 2/1962 | Navikas | 53/27 |
| 3,074,798 | 1/1963 | Palmer | 99/174 |
| 3,360,382 | 12/1967 | Miller | 99/174 |
| 3,574,642 | 4/1971 | Weinke | 99/174 |
| 3,681,092 | 8/1972 | Titchenal et al. | 99/174 |
| 3,808,394 | 4/1974 | Mominee et al. | 219/121 |
| 3,843,806 | 10/1974 | Kishpaugh et al. | 426/106 |
| 4,055,672 | 10/1977 | Hirsch et al. | 426/127 |
| 4,264,392 | 4/1981 | Watt | 156/272 |
| 4,438,850 | 3/1984 | Kahn | 206/634 |
| 4,522,835 | 6/1985 | Woodruff et al. | 426/264 |
| 4,590,078 | 5/1986 | Umina | 426/113 |
| 4,634,614 | 1/1987 | Holzner | 428/35 |
| 4,667,814 | 5/1987 | Wakamatsu et al. | 206/0.7 |
| 4,700,531 | 10/1987 | Hsu et al. | 53/412 |
| 4,840,271 | 6/1989 | Garwood | 206/213 |
| 4,842,875 | 6/1989 | Anderson | 426/118 |
| 4,847,148 | 7/1989 | Schirmer | 428/332 |
| 4,886,372 | 12/1989 | Greengrass et al. | 383/100 |
| 4,886,690 | 12/1989 | Davis et al. | 428/36.6 |
| 4,889,731 | 12/1989 | Williams, Jr. | 426/106 |
| 4,910,033 | 3/1990 | Bekele et al. | 426/129 |
| 5,045,331 | 9/1991 | Antoon, Jr. | 426/118 |
| 5,079,059 | 1/1992 | Wyslotsky | 428/43 |
| 5,132,151 | 7/1992 | Graney | 428/40 |
| 5,226,531 | 7/1993 | Garwood | 206/213 |
| 5,296,291 | 3/1994 | Mueller | 428/349 |

(List continued on next page.)

FOREIGN PATENT DOCUMENTS

| | | |
|---|---|---|
| 0 261 930 | 9/1987 | European Pat. Off. . |
| 0 270 764 | 10/1987 | European Pat. Off. . |
| 0 698 563 A1 | 8/1995 | European Pat. Off. . |
| 690 012 | 1/1996 | European Pat. Off. . |
| 1 097 637 | 1/1968 | Germany . |
| 2 240 234 | 8/1972 | Germany . |
| 2 251 540 | 1/1991 | United Kingdom . |
| 87/02965 | 11/1985 | WIPO . |

*Primary Examiner*—Ellis Robinson
*Assistant Examiner*—Jennifer M. Hayes
*Attorney, Agent, or Firm*—Thomas C. Lagaly

[57] ABSTRACT

A case-ready package and method of reducing discoloration in meat or poultry products enclosed within such packages when the packages are disposed in a stack of two or more packages. A non-textured and substantially smooth gas-permeable substrate is attached to the lower surface of the packages to allow air to flow into an underlying package in a stack of packages, thereby preventing or minimizing premature discoloration of packaged fresh meat or poultry product due to insufficient oxygen flow into such packages when disposed in a stack. In addition, the substrate may contain printed product indicia either directly or in the form of a label attached thereto.

19 Claims, 9 Drawing Sheets

U.S. PATENT DOCUMENTS 5,402,622 4/1995 Stockley, III et al. ..... 53/427
5,419,097 5/1995 Gorlich et al. ..... 53/432
5,439,132 8/1995 Gorlich ..... 220/359
5,492,705 2/1996 Porchia et al. ..... 426/106
5,518,790 5/1996 Huber et al. ..... 428/35.2
5,560,182 10/1996 Garwood ..... 53/432
5,686,126 11/1997 Noel et al. ..... 426/127

CASE-READY PACKAGES HAVING SMOOTH, GAS-PERMEABLE SUBSTRATES ON THE BOTTOMS THEREOF TO REDUCE OR PREVENT DISCOLORATION WHEN PLACED IN A STACK

BACKGROUND OF THE INVENTION

The present invention relates to packaging for products, such as fresh red meat or other food products, which are enclosed between a support member and a lid, wherein the lid includes a gas-permeable portion and a substantially gas-impermeable portion which is peelably removable from the gas-permeable portion such that the gas-permeable portion remains bonded to the support member, thereby effecting a change in the environmental conditions within the package. More specifically, the invention relates to such packaging wherein individual packages have the gas-impermeable portions thereof peelably removed and are stacked in a retail display case for consumer purchase, thereby creating the possibility that the packaged products in all but the top-most package will become discolored due to oxygen starvation.

Various forms of packaging, particularly for fresh food products such as meat, poultry, and produce, employ a relatively rigid support member, such as a flat sheet or tray, upon or in which a product is supported. A relatively flexible lid or cover is bonded to the support member around the product, generally by forming a heat-seal between the lid and support member, to thereby enclose the product between the lid and support member. This type of packaging is known as "case-ready" packaging because it is generally prepared at a central packaging facility and shipped to a retail outlet in such a form that it is substantially ready to be placed in a retail display case for consumer inspection and purchase without the need for in-store packaging as had traditionally been necessary for fresh foods.

Case-ready packaging encompasses two major varieties: "vacuum" packaging and "modified-atmosphere" packaging. In vacuum, e.g., "vacuum skin" packaging, the lid is thermoformable, i.e., capable of being formed into a desired shape upon the application of heat, and is thermoformed about the product on a support member by means of heat and differential pressure. Virtually all of the air is evacuated from the interior of the package so that the lid conforms very closely to the contour of the packaged product (see, e.g., U.S. Pat. Nos. Re 30,009 (Purdue et al.) and 5,346,735 (Logan et al.), the disclosures of which are hereby incorporated herein by reference). In modified-atmosphere packaging, a food product is generally packaged in a tray-like support member having a peripheral flange to which the lid is secured. Prior to securing the lid to the support member, air is generally evacuated from the interior of the support member and replaced by a gas which extends the shelf-life of the packaged product.

When the packaged product is one which degrades in the presence of oxygen, such as, e.g., beef, poultry, or pork, the product is packaged in a low-oxygen environment and the lid and support member generally provide a substantial barrier to the passage of oxygen therethrough to extend the shelf-life of the packaged product. However, such products may have an unappealing appearance when packaged in a low-oxygen environment. For example, while a low-oxygen packaging environment generally increases the shelf-life of a packaged fresh red meat product (relative to meat products packaged in an environment having a higher oxygen content), red meat has a tendency to assume a purple color when packaged in the absence of oxygen or in an environment having a very low oxygen concentration, i.e., below about 5% oxygen. Such a purple color is undesirable to most consumers, and marketing efforts to teach the consumer about the acceptability of the purple color have been largely ineffective. When meat is exposed to a sufficiently high concentration of oxygen, e.g., as found in air, it assumes a bright red color which most consumers associate with freshness. After 1 to 3 days of such exposure, however, meat assumes a brown color which, like the purple color, is undesirable to most consumers (and indicates that the meat is beginning to spoil). Thus, in order to effectively butcher and package fresh red meat products in a central facility for distribution to retail outlets, the meat is packaged, shipped, and stored in a low-oxygen (vacuum or modified-atmosphere) environment for extended shelf-life, and then displayed for consumer sale in a relatively high-oxygen environment such that the meat is caused to "bloom" into a red color just before being placed in a retail display case. A similar, though not as dramatic, color change occurs with other muscle food products such as poultry and pork.

Blooming of e.g., fresh meat, poultry, or pork products is typically accomplished by constructing the lid of a case-ready package such that it includes a gas-permeable portion and a gas-impermeable portion, with the gas-impermeable portion being peelably removable from the gas-permeable portion in such a manner that the packaged product continues to be enclosed between the gas-permeable portion and support member. Thus, when it is desired to place the package in a retail display case for consumer purchase, the gas-impermeable portion of the lid is peelably removed from the package. Since the remaining portion of the lid is permeable to gas (oxygen), it allows the meat product to bloom in the presence of oxygen which enters the package from the ambient atmosphere. At the same time, the remaining gas-permeable portion of the lid continues to provide protection to the product from, e.g., dirt, dust, moisture, microbial contaminates, etc.

A problem which frequently occurs with case-ready packages, however, is that after the gas-impermeable portion of the lids are removed so that the packaged products bloom, the packages are placed in a retail display case in a stacked configuration, i.e., stacked one on top of the other so that the support member of all but the bottom-most package in the stack is in contact with the remaining gas-permeable lid portion of the package located immediately below. Such stacking arrangement is necessary due to space constraints in retail display cases, and allows the retailer to maximize the number of packages which can be displayed for consumer purchase. Unfortunately, the products packaged in all but the top-most package in the stack often become discolored due to insufficient oxygen flow to such products as a result of intimate contact between the gas-permeable lid portion and the support member of the overlying package in the stack. Since support members in case-ready packages normally consist of gas-impermeable materials, their contact with the gas-permeable lid portion of an underlying package in a stack of packages prevents sufficient oxygen flow through the gas-permeable lid to maintain all or a portion of the underlying packaged product in a state of bloom. The resulting product discoloration is aesthetically unappealing to the consumer, who may assume that the packaged product is defective in some way, e.g., spoiled or beginning to spoil. As can be readily appreciated, this is highly undesirable to the retailer. The problem does not occur to any great extent with traditional retail-packaged cuts of meat because the overwrapping used to enclose the meat product is gathered or folded at the underside of the meat product or a tray used to support the meat product, and allows oxygen to flow into the underlying package in a stack. Accordingly, in order to compete successfully with traditional retail-packaged meat or poultry, case-ready packages must overcome the problem of oxygen starvation of underlying packages in a stack of packages.

One potential solution to this problem is to employ support members having a textured bottom surface so that oxygen can flow between the bottom surface of the support member and into the underlying package in a stack via the gas-permeable lid of the underlying package. While this approach has been successful in many respects, certain drawbacks remain. By definition, a textured surface has a non-smooth or roughened finish with segments (peaks or ridges) that extend from the surface with greater prominence than other segments (valleys). When packages having textured bottom surfaces are placed in a stack, the textured bottoms of all but the lowest package in the stack are forced by gravity against the flexible lids of all but the upper-most package in the stack. The flexible lids of the underlying packages in the stack are, in turn, pressed into the surface of any portion of the packaged products which are in contact with the lids. As a result, both the lids and contacting surface of the products are essentially embossed with the textured pattern of the bottom support member surface of the overlying packages in the stack. The prominent segments of the textured surface produce corresponding indentations in the lid and product surface in the underlying packages. Such indentations in the surface of the packaged products are generally undesirable for aesthetic reasons. Moreover, in the case of fresh meat and poultry products, the indented areas can discolor prematurely due to insufficient oxygen flow thereto, thereby creating a textured pattern of discoloration on the surface of the products in the underlying packages in a stack of such packages.

Another drawback of case-ready packages having a textured bottom surface is that the textured surface does not permit the attachment of a label thereto or direct surface printing thereon bearing desired indicia such as, e.g., product identification or nutritional information. The ability to provide such indicia on the bottom surface of case-ready packages would be a highly desirable feature.

Accordingly, there is a need in the art for case-ready packages which prevent discoloration of packaged products when placed in a stack and which avoid the foregoing shortcomings of case-ready packages having a textured bottom surface.

SUMMARY OF THE INVENTION

That need is met by the present invention which provides a package, comprising:

a. a substantially gas-impermeable support member having an upper surface and a lower surface and supporting a product on the upper surface thereof;

b. a lid bonded to the upper surface of support member about the periphery of the product to enclose the product between the support member and the lid, the lid comprising a gas-permeable portion and a substantially gas-impermeable portion, the substantially gas-impermeable portion being peelably removable from the gas-permeable portion such that the gas-permeable portion remains bonded to the support member and continues to enclose the product following removal of the substantially gas-impermeable portion, said lid further including a mechanism to initiate peeling of said gas-impermeable portion from said gas-permeable portion; and c. a gas-permeable substrate attached to the lower surface of the support member, the substrate having at least one principal surface which is non-textured and substantially smooth.

The gas-permeable substrate on the lower surface of the support member allows air to flow into an underlying package in a stack of packages, thereby preventing or minimizing premature discoloration of a packaged fresh meat or poultry product. In addition, the substrate may contain printed product indicia either directly or in the form of a label attached thereto.

The invention also provides a method of reducing discoloration in meat or poultry products enclosed within packages when the packages are disposed in a stack of two or more packages. The method comprises:

a. providing at least a first package and a second package, each of the first and second packages comprising
   1) a substantially gas-impermeable support member having an upper surface and a lower surface and supporting a product on the upper surface thereof;
   2) a lid bonded to the upper surface of the support member about the periphery of the product to enclose the product between the support member and the lid, the lid comprising a gas-permeable film, and
   3) a gas-permeable substrate attached to the lower surface of the support member, the substrate having at least one principal surface which is non-textured and substantially smooth; and b. stacking the first package on top of the second package such that the support member of the first package is in contact with the gas-permeable lid of the second package, the gas-permeable substrate attached to the lower support member surface of the first package being positioned between the lower support member surface of the first package and the upper surface of the gas-permeable lid of the second package.

A package in accordance with another aspect of the invention comprises:

a. a bag comprising a gas-permeable thermoplastic film and enclosing a product therewithin, the bag having an interior surface in contact with the product and an exterior surface; and b. a gas-permeable substrate attached to at least a portion of the exterior surface of the bag, the substrate having at least one principal surface which is non-textured and substantially smooth.

Definitions

As used herein, the phrase "non-textured and substantially smooth" refers to a substrate which, when positioned between the bottom support member surface of a first case-ready package and the flexible lid of a second case-ready package positioned immediately beneath and in contact with the first package, leaves substantially no indentations on the surface of a product contained within the second package. A "non-textured and substantially smooth" substrate preferably has an "RA" value of less than 3, as that term is defined in U.S. Pat. No. 4,910,033, the disclosure of which is hereby incorporated herein by reference (an "RA" value is a measure of the relative average of the size of peaks and valleys in a given area of material, is expressed in micro inches (i.e., one millionth of an inch), and may be measured with a profolometer).

As used herein, the phrase "gas-permeable" refers to a film or film portion which admits at least about 1,000 cc of gas, such as oxygen, per square meter of film per 24 hour period at 1 atmosphere and at a temperature of 73° F. (at 0% relative humidity). More preferably, a gas-permeable film or film portion admits at least 5,000, even more preferably at least 10,000, such as at least 15,000, 20,000, 25,000, 30,000, 35,000, 40,000, and 50,000, and most preferably at least 100,000 cc of oxygen per square meter per 24 hour period at 1 atmosphere and at a temperature of 73° F. (at 0% relative humidity). In accordance with the present invention, a gas-permeable film or film portion can itself have the aforedescribed levels of gas permeability or, alternatively, can be a film or film portion which does not inherently possess the aforedescribed levels of gas permeability but which is altered, e.g., perforated or peelably delaminated, to render the film gas-permeable as defined above.

As used herein, the phrase "substantially gas-impermeable" refers to a film or film portion which admits less than 1000 cc of gas, such as oxygen, per square meter of film per 24 hour period at 1 atmosphere and at a temperature of 73° F. (at 0% relative humidity). More preferably, a substantially gas-impermeable film admits less than about 500, such as less than 300, and less than 100 cc of gas; more preferably still less than about 50 cc, and most preferably less than 25 cc, such as less than 20, less than 15, and less than 10 cc of gas per square meter per 24 hour period at 1 atmosphere and at a temperature of 73° F. (at 0% relative humidity).

As used herein, the phrase "support member" refers to a component of a package on or in which a product is disposed. Meat products are typically disposed in a tray-like package component comprising, e.g., expanded (foamed) or non-foamed polystyrene sheet material which has been thermoformed into a desired shape, for supporting the meat product. A support member preferably includes a cavity into which the product is disposed and a peripheral flange which provides a sealing surface for attachment of a lid to the support member to thereby enclose the product within the cavity. A support member may also include a substantially flat, i.e., non-thermoformed, sheet which may be foamed or non-foamed.

As used herein, the term "film" refers generally to a thermoplastic material, generally in sheet or web form, having two principal surfaces and comprising one or more layers formed from polymeric or other materials. A film can be a monolayer film (having only one layer) or a multilayer film (having two or more layers).

As used herein, the term "layer" refers generally to a discrete film component which is coextensive with the film and has a substantially uniform composition. In a monolayer film, the "film" and "layer" would be one and the same.

As used herein, the term "multilayer film" refers to a thermoplastic material, generally in sheet or web form, having one or more layers formed from polymeric or other materials which are bonded together by any conventional or suitable method, including but not limited to one or more of the following methods: coextrusion, extrusion coating, lamination, vapor deposition coating, solvent coating, emulsion coating, suspension coating, etc. Such methods are well known in the art. For example, "coextrusion," "coextrude," and the like refer to the process of extruding two or more materials through a single die with two or more orifices arranged so that the extrudates merge and weld together into a laminar structure before chilling, i.e., quenching. Coextrusion can be employed in film blowing, free film extrusion, and extrusion coating processes. As a further example, "lamination," "laminate," and the like refer to a multiple-film composite structure having two or more films which are bonded together by any suitable means, including adhesive bonding; reactive surface modification (e.g., corona treatment, flame treatment, or plasma treatment); heat treatment; pressure treatment; etc., including combinations thereof.

As used herein, the phrase "reactive surface modification" and the like refers to chemically altering the surface of a film in order to incorporate reactive species onto such film surface, e.g., to provide the film surface with auto-adhesion functionality (i.e., rendering the surface capable of adhering to another surface without the need for an adhesive). Specific examples of reactive surface modification include corona treatment, plasma (ionized gas) treatment, and flame treatment, with corona treatment being preferred. The surface of a film which has been subjected to reactive surface modification is referred to as a "modified surface" or, in the case of corona treatment, a "corona treated surface."

As used herein, the terms "delaminate," "delamination," and the like refer generally to the internal separation of a multilayer film within a layer and/or at an inter-layer (i.e., layer/layer) or inter-film (film/film) interface within the multilayer film when such film is subjected to a peel force of sufficient magnitude. A laminate of two or more films in accordance with the present invention may include a coextruded film having an intra-film cohesive strength which is both lower than the interfilm bond-strengths between the component films of the laminate and also lower than the intra-film cohesive strengths of the other films in the laminate. In this manner, the coextruded film component of the laminate internally separates, i.e., delaminates, when the laminate is subjected to a peel force which exceeds the intra-film cohesive strength of the coextruded film.

As used herein, the term "intra-film cohesive strength" refers to the internal force with which a film remains intact, as measured in a direction that is perpendicular to the plane of the film. In a multilayer film, intra-film cohesive strength is provided both by inter-layer adhesion (the adhesive strength between the layers which binds them to one another) and by the intra-layer cohesion of each film layer (i.e., the cohesive strength of each of the film layers). In a monolayer film, intra-film cohesive strength is provided only by the intra-layer cohesion of the layer which constitutes the film.

As used herein, the term "peel force" refers to the amount of force required to ply-separate two films of a multi-film laminate or two layers of a multilayer film, as measured in accordance with ASTM F904-91.

As used herein, the term "bond-strength" (or "seal-strength") refers generally to the adhesive force with which two adjacent films, or two adjacent film layers, are connected, e.g., by coextrusion, lamination, or via a heat-seal, in accordance with ASTM F88-94.

As used herein, the term "heat-seal" (also known as a "heat-weld") refers to the union of two films or other thermoplastic articles by bringing the films into contact, or at least close proximity, with one another and then applying sufficient heat and pressure to a predetermined area (or areas) of the films to cause the contacting surfaces of the films in the predetermined area to become molten and intermix with one another, thereby forming an essentially inseparable bond between the two films in the predetermined area when the heat and pressure are removed therefrom and the area is allowed to cool. In accordance with the practice of the present invention, a heat-seal preferably creates a hermetic seal, i.e., a barrier to the outside atmosphere.

As used herein, the terms "peel," "peeling," "peelably" and the like refer generally to the act of removing one or more films and/or film layers from a lid comprising a multi-film laminate and/or a multi-layer film by manually grasping and pulling back one or more films and/or layers of the lid along a plane or interface of relatively low bond-strength. The phrase "peelably removable" refers to one or more films and/or film layers of such a lid which may be peeled therefrom.

DETAILED DESCRIPTION OF THE INVENTION

Figure 1:
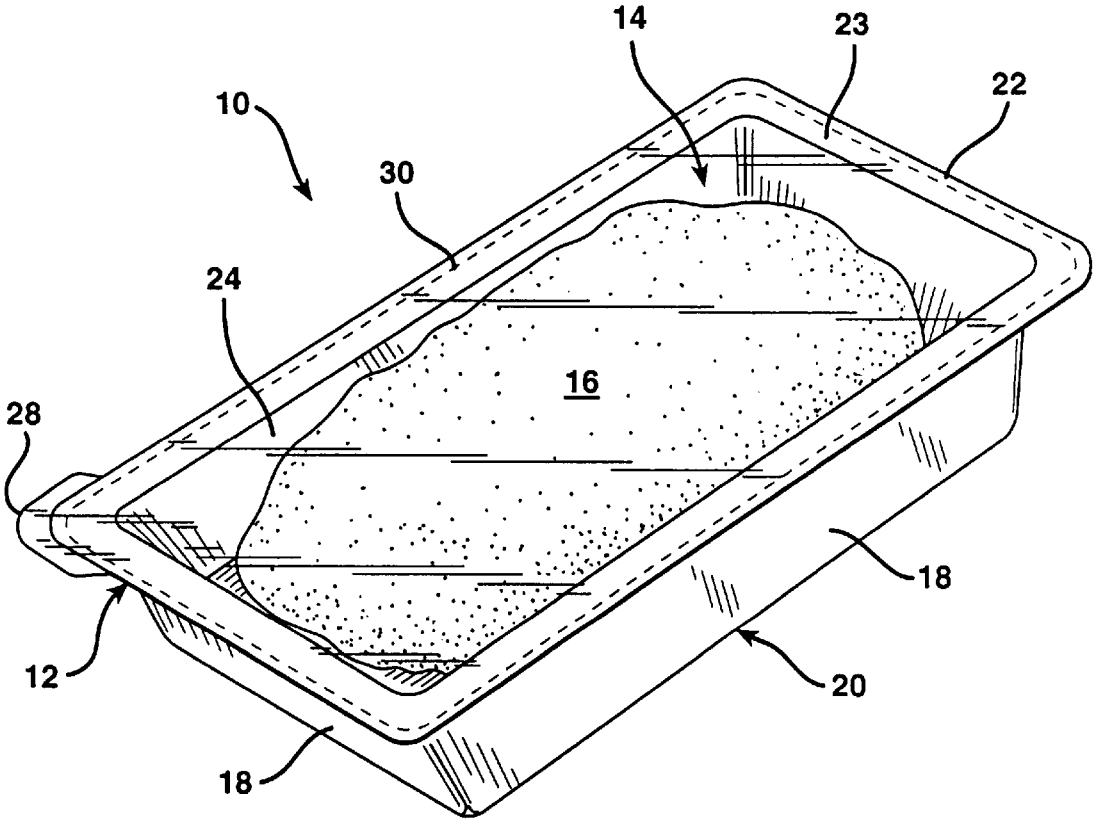
FIG. 1 is a perspective view of a case-ready, modified-atmosphere package in accordance with the present invention, including a product support member with a product disposed therein and a lid heat-sealed to the support member to enclose the product between the support member and lid, and a gas-permeable substrate attached to the lower surface of the support member.

FIG. 1 illustrates a modified-atmosphere type case-ready package 10 which includes product support member 12 having a cavity 14 formed therein and a product 16 disposed within the cavity. Support member 12 is preferably in the form of a tray having side walls 18 and a base 20 which define the cavity 14, and further includes a peripheral flange 22 extending outwardly from the cavity. A lid 24 is bonded to flange 22 to enclose product 16 between support member 12 and the lid. Preferably, lid 24 is bonded to flange 22 via heat-seal 30 (represented in phantom) which extends substantially continuously around the upper surface 23 of flange 22 to enclose product 16 within cavity 14 of package 10. Lid 24 preferably includes a peel tab 28 which, as will be explained below, initiates the peelable removal of the gas-impermeable portion of lid 24. Further details concerning such peel tab are disclosed in copending U.S. application Ser. No. 08/814,671, filed Mar. 11, 1997 and entitled LIDDED PACKAGE HAVING A TAB TO FACILITATE PEELING, the disclosure of which is hereby incorporated herein by reference. As an alternative to peel tab 28, other peel-initiation mechanisms may also be employed, such as an edge or corner portion of lid 24 which is partially or completely severed and/or not heat-sealed to flange 22 as disclosed in, e.g., U.S. Pat. Nos. 4,889,731 (Williams) and 5,402,622 (Stockley et al.), and in copending U.S. application Ser. No. 08/733,843 filed Oct. 18, 1996 and entitled PACKAGE HAVING PEEL INITIATION MECHANISM, the disclosures of which are hereby incorporated herein by reference.

In general, any support member/heat-seal configuration may be employed so long as the heat-seal extends substantially continuously about the product to enclose the product between the lid and support member. For example, support member 12 can be a substantially flat sheet with product 16 disposed thereon and with heat-seal 30 forming a closed geometric pattern about the base of the product to form an enclosure therefor. An example. of this latter packaging arrangement is a vacuum skin package as described above, in which the product is packaged under vacuum and the space between the lid and support member containing the product is evacuated of gases so that the lid substantially completely conforms to the contour of the packaged product.

Lid 24 and support member 12 preferably form a substantially gas-impermeable enclosure for product 16 which protects the product from contact with the surrounding environment including, in particular, atmospheric oxygen, but also including dirt, dust, moisture, microbial contaminates, etc., especially when product 16 is a food product. When product 16 is oxygen-sensitive, i.e., perishable, degradable, or otherwise changeable in the presence of oxygen, such as fresh red meat products (e.g., beef, veal, lamb, pork, etc.), poultry (chicken, turkey, etc.), fish, cheese, and certain fruits or vegetables, it is preferred that product 16 be packaged in a low-oxygen environment within package 10 to maximize the shelf-life of the product. Suitable low-oxygen environments are discussed below.

Support member 12 can have any desired configuration or shape, e.g., rectangular, round, oval, etc. Similarly, flange 22 may have any desired shape or design, including a simple, substantially flat design which presents a single sealing surface as shown, or a more elaborate design, e.g., one which presents two or more sealing surfaces, such as the flange configurations disclosed in U.S. Pat. Nos. 5,348,752 and 5,439,132, the disclosures of which are hereby incorporated herein by reference.

Suitable materials from which support member 12 can be formed include, without limitation, polyvinyl chloride, polyethylene terephthalate, polystyrene, polyolefins such as high density polyethylene or polypropylene, paper pulp, nylon, polyurethane, etc. The support member may be foamed (expanded) or non-foamed as desired, and preferably provides a barrier to the passage of oxygen therethrough, particularly when product 16 is a food product which is oxygen-sensitive. When such oxygen-sensitive products are to be packaged in a low-oxygen environment (to thereby extend their shelf-life), support member 12 preferably allows less than or equal to about 1000 cc of oxygen to pass, more preferably less than about 500 cc of oxygen, more preferably still less than about 100 cc, even more preferably less than about 50 cc, and most preferably less than about 25 cc of oxygen to pass per square meter of material per 24 hour period at 1 atmosphere and at a temperature of 73° F. (at 0% relative humidity). Support member 12 may be formed from a material which itself provides a barrier to the passage of oxygen, e.g., vinylidene chloride copolymer, nylon, polyethylene terephthalate, ethylene/vinyl alcohol copolymer, etc. Alternatively, support member 12 may have a substantially gas-impermeable film laminated or otherwise conformably bonded to the inner (upper) surface thereof to form a liner for the support member, as disclosed in U.S. Pat. Nos. 4,847,148 and 4,935,089, and in U.S. Ser. No. 08/326,176, filed Oct. 19, 1994 and entitled "Film/Substrate Composite Material" (published as EP 0 707 955 A1 on Apr. 24, 1996), the disclosures of which are hereby incorporated herein by reference. If desired, the gas-impermeable film may form the outer (lower) surface of the support member and be peelably removable therefrom so that oxygen can then enter the package, e.g., at retail, via the support member. The gas-impermeable film or liner, which is referred to hereinbelow as a "barrier/sealant film," preferably includes an oxygen-barrier material such as e.g., vinylidene chloride copolymer (saran), nylon, polyethylene terephthalate, ethylene/vinyl alcohol copolymer, etc.

As desired, product 16 may have a maximum height which is below the maximum height of support member 12, i.e., below the level at which flange 22 is located. Alternatively, product 16 may have a maximum height which is above or substantially at the level at which flange 22 is located so that the uppermost surface of the product is in contact with lid 24. As a further alternative, support member 12 may, as stated above, be a substantially flat sheet, in which case the packaged product is positioned substantially completely above the support member and is enclosed with a lid that conforms to the upper contour of the product.

Figure 2:
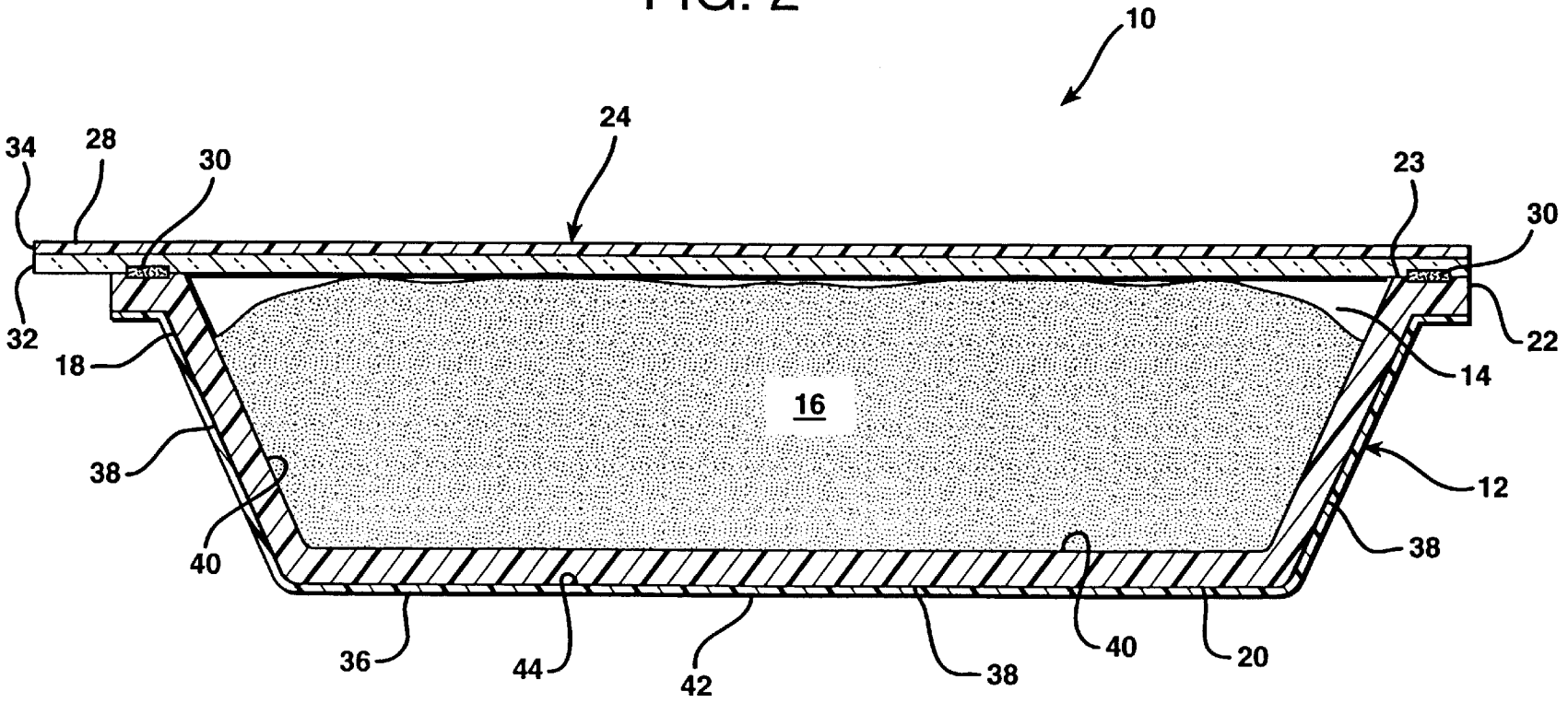
FIG. 2 is a schematic, cross-sectional view of the package shown in FIG. 1.

FIG. 2 illustrates in greater detail the package shown in FIG. 1. Lid 24 includes a gas-permeable portion 32 and a substantially gas-impermeable portion 34. Gas-impermeable portion 34 is peelably removable from gas-permeable portion 32 in such a manner that gas-permeable portion 32 remains bonded to support member 12 so that product 16 continues to be enclosed between the gas-permeable lid portion 32 and support member 12 following the removal of gas-impermeable portion 34. Peelable removal of gas-impermeable portion 34 can be accomplished in a number of ways, some of which are described hereinbelow. This feature of the invention is useful when it is desired to package, ship, and store product 16 in one atmospheric state and then display it for consumer purchase in another atmospheric state while the product remains enclosed in the same package. As noted above, it is particularly beneficial to package fresh meat or poultry products in this manner, wherein such products are packaged in a gaseous environment which preserves the product during shipping and storage. Subsequently, the products are displayed for customer purchase in the same package but wherein air has been permitted to displace the preservation gas by peeling the gas-impermeable film from the package so that an exchange of gases inside of the package occurs via the remaining gas-permeable film. In this manner, such products are displayed in a state of "bloom" which consumers associate with freshness.

As also noted above, packages containing bloomed fresh meat or poultry products are typically displayed for consumer purchase in refrigerated display cases in a stacked configuration in order to maximize the number of packages which can be displayed. This can result in premature discoloration of the packaged products in all but the top packages in the stack due to insufficient oxygen flow to the lower packages in the stack. This is a result of intimate contact between the bottom surface of the overlying packages and the upper surface of the exposed permeable lid portion of the underlying packages in the stack which prevents the free flow of oxygen from the ambient atmosphere and to the surface of the meat or poultry products enclosed within such underlying packages. The problem is most prominent when the height of product 16 and/or the flexibility of the remaining lid portion is such that the lower surface of the lid portion is pressed into contact with the upper surface of the meat product as shown by the lower package in FIG. 3.

The present invention overcomes the foregoing problem by providing a gas-permeable substrate 36 attached to the lower surface 38 of support member 12. The "lower surface" 38 of support member 12 includes the entire exterior surface of the support member including the side walls 18, base 20, and flange 22, and is referred to as a "lower" surface to denote the exterior surface when the support member is in an upright position as shown in the drawings. In this context, support member 12 also includes an "upper surface" 40 which is the interior surface of the support member in contact with product 16, with the term "upper" referring to the interior surface of the support member when in an upright position as shown.

A particular advantage of the present invention is that gas-permeable substrate 36 has at least one principal surface 42 which is "non-textured and substantially smooth" as defined hereinabove, such substantially smooth surface preferably being an exterior surface which is opposite the surface 44 of substrate 36 that is in adherence with the lower surface 38 of support member 12. In this manner, when package 10 is an upper package in a stack 46 (see FIG. 3) and disposed on top of a lower, identical package 10', with the gas-impermeable lid portion of the lower package having been removed, air can flow into the lower package 10' via the gas-permeable substrate 36 of upper package 10 and the remaining gas-permeable lid portion 32 of lower package 10', thereby allowing product 16 to be maintained in a state of bloom and without premature discoloration due to oxygen deprivation.

Figure 3:
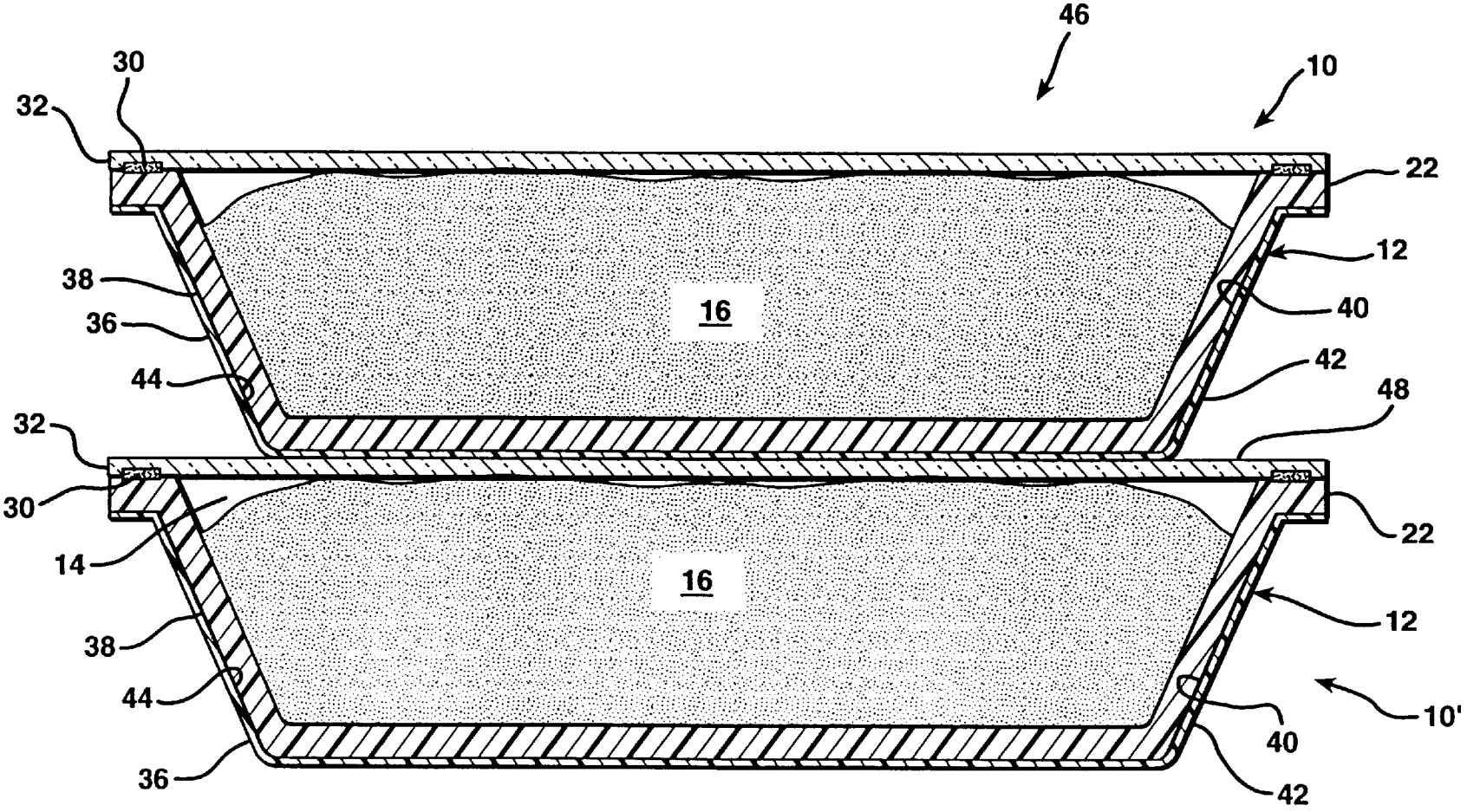
FIG. 3 is a schematic, cross-sectional view of the packages shown in FIGS. 1 and 2, wherein two of such packages have had a portion of the lids removed and have been stacked one on top of the other.

The stacked arrangement shown in FIG. 3 is typical of the manner in which case-ready packages are placed in retail display cases, with two or more packages stacked in a substantially vertical column, each of which having had their gas-impermeable lid portions removed to allow air to displace the gas in which the products were initially packaged. As shown, support member 12 of upper package 10 is urged into contact with the remaining gas-permeable lid portion 32 of lower package 10'. Depending upon the height of the packaged product and/or the flexibility of lid portion 32, the gas-permeable lid portion may, in turn, be urged against the top of the product as shown in package 10'. Such film-to-product contact when case-ready packages are placed in a stack is typical. This will typically occur, e.g., when product 16 is ground meat or ground poultry. In accordance with the invention, the gas-permeable substrate 36 attached to lower support member surface 38 of upper package 10 is positioned between such lower support member surface and the upper surface 48 of gas-permeable lid portion 32 of lower package 10'. It has been found that, when used in this manner, gas-permeable substrate 36 allows sufficient oxygen flow from the ambient atmosphere and into the cavity 14 of lower package 10' that, when product 16 is a bloomable product such as fresh meat or poultry, the product remains in a state of bloom with little or no premature discoloration from oxygen deprivation. This is true even when the gas-permeable lid portion 32 is pressed into contact with the upper surface of product 16 due to the height of the product and the pressure exerted thereon by the weight of the overlying package 10 (and possibly others which may be positioned on top of package 10) as shown.

For reasons which are not fully understood, air is believed to travel laterally through gas-permeable substrate 36 in order to enter the cavity 14 of lower package 10'. This was unexpected, in that non-textured and substantially smooth materials, even when highly gas-permeable, are not considered to be highly gas-permeable in such a lateral or planar direction, but rather in a direction which is substantially perpendicular to the planar dimensions of the substrate. This discovery leads to several advantages in the practice of the present invention. Unlike a textured surface on the bottom of a support member to promote air flow between stacked packages (which has previously been practiced), a non-textured/substantially smooth surface does not result in pointed, lined, or patterned segments of discoloration on the surface of the underlying packaged product due to corresponding points, lines, or patterns of pressure exerted by an overlying package having a textured bottom surface. Similarly, the surface of the product does not contain indentations corresponding to the pattern of the textured bottom surface of the overlying package. Moreover, a non-textured/substantially smooth bottom surface permits the attachment thereto, or direct printing thereon, of a label bearing desired information such as, e.g., product identification, weight, nutritional information, etc.

In general, gas-permeable substrate 36 can be formed from any material having at least one principal surface meeting the above definition of "non-textured and substantially smooth." The gas-permeable substrate preferably has a gas transmission rate of at least about 5,000 cc/m$^2$/24 hrs./atm. at 73° F. Preferred materials include, e.g., polystyrene film and woven or non-woven fibrous sheet material.

Preferred examples of polystyrene film include oriented polystyrene film and high impact polystyrene film. When polystyrene film, or any other thermoplastic film having a gas transmission rate of at least about 5,000 cc/m$^2$/24 hrs./atm. at 73° F., is used for substrate 36, it is preferred that the support member 12 comprise a foamed (expanded) material, such as polystyrene foam.

Woven or non-woven fibrous sheet materials may be formed from, e.g., polyolefin, polyester, or plant fibers (i.e., cotton, wood, etc.). Particularly preferred fibrous sheet materials include non-woven, spunbonded polyester or polyolefin, which are commercially available, e.g., from DuPont under the tradename TYVEK®. At present, TYVEK® 1059B and 1073B spun-bonded polyolefin (believed to be non-woven high density polyethylene fibers) are preferred because such materials are approved by the FDA and USDA for direct food contact. Other microporous materials which are well known in the art may also be used.

As shown in FIGS. 2 and 3, gas-permeable substrate 36 may be coextensive with the lower surface 38 of support member 12. In this case, substrate 36 may be attached to support member 12 by coextruding the two materials and then thermoforming the resultant composite structure to form a desired three-dimensional configuration, e.g., a flanged tray as shown in FIGS. 1–3. In the case of a vacuum skin package, the coextruded composite structure could simply be left as a flat sheet, i.e., without thermoforming. As an alternative to coextrusion, substrate 36 may be laminated to support member 12 by any suitable lamination technique, either before or after thermoforming (if applicable).

Figure 6:
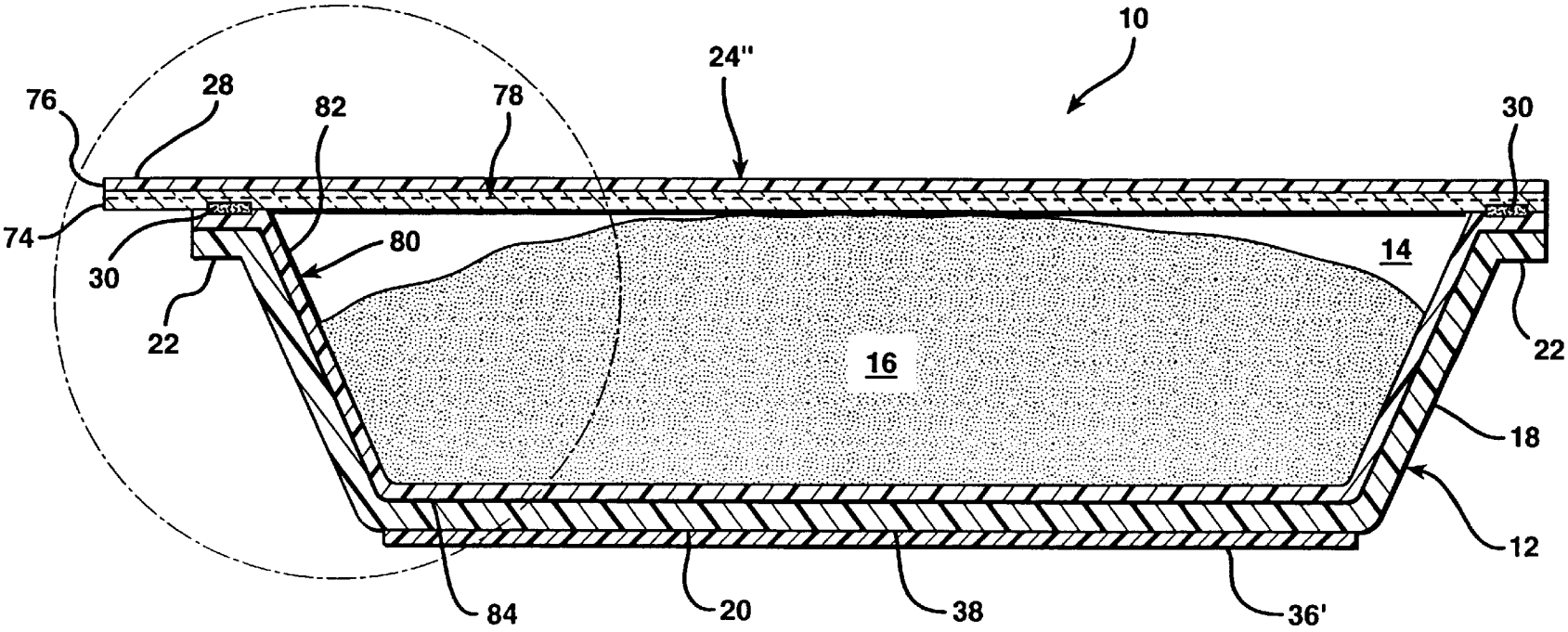
FIG. 6 is an alternative embodiment of the package shown in FIG. 2.
Figure 7:
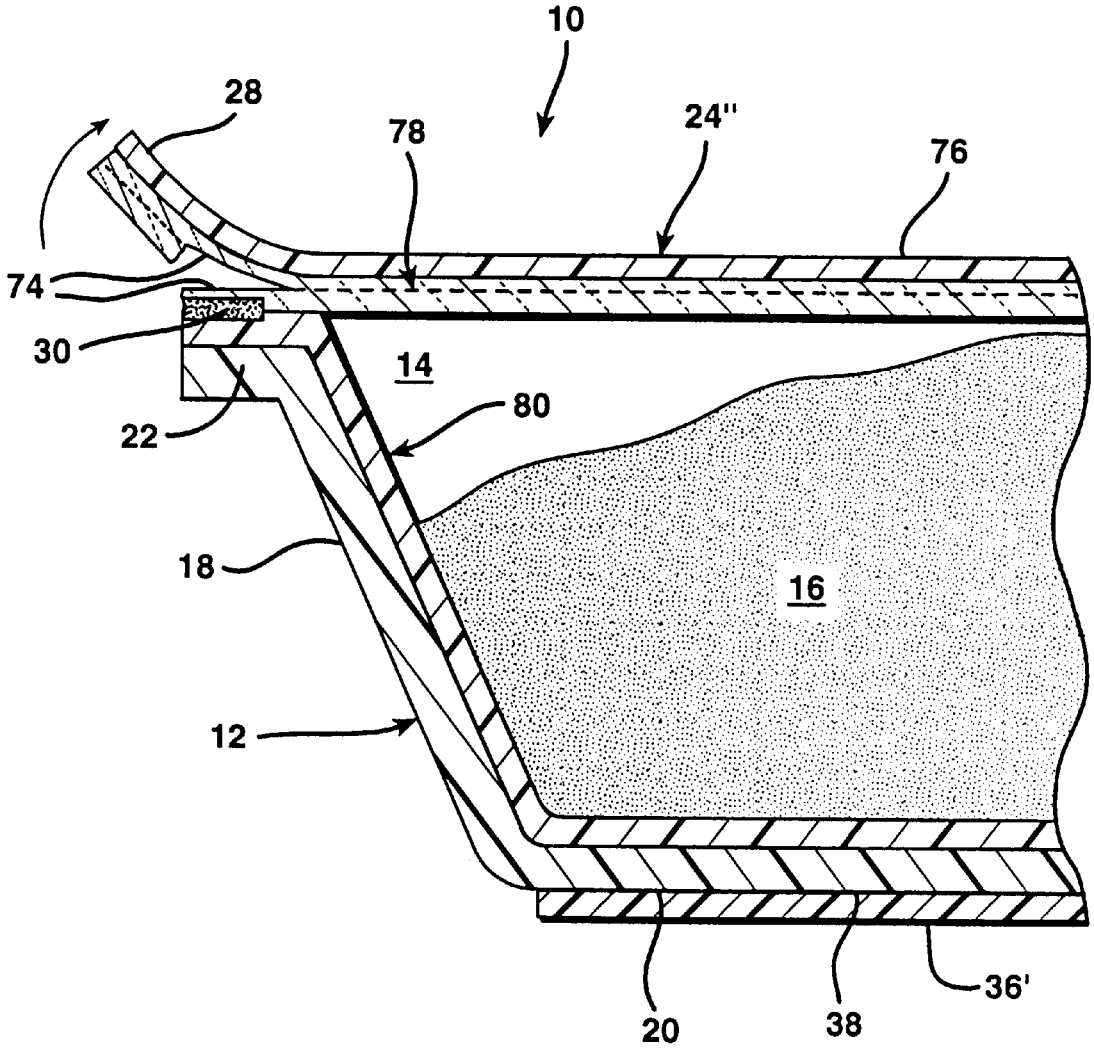
FIG. 7 is an enlarged cross-sectional view of a portion of the package illustrated in FIG. 6, wherein peelable delamination of the lid within the gas-permeable lid portion has been initiated.
Figure 8:
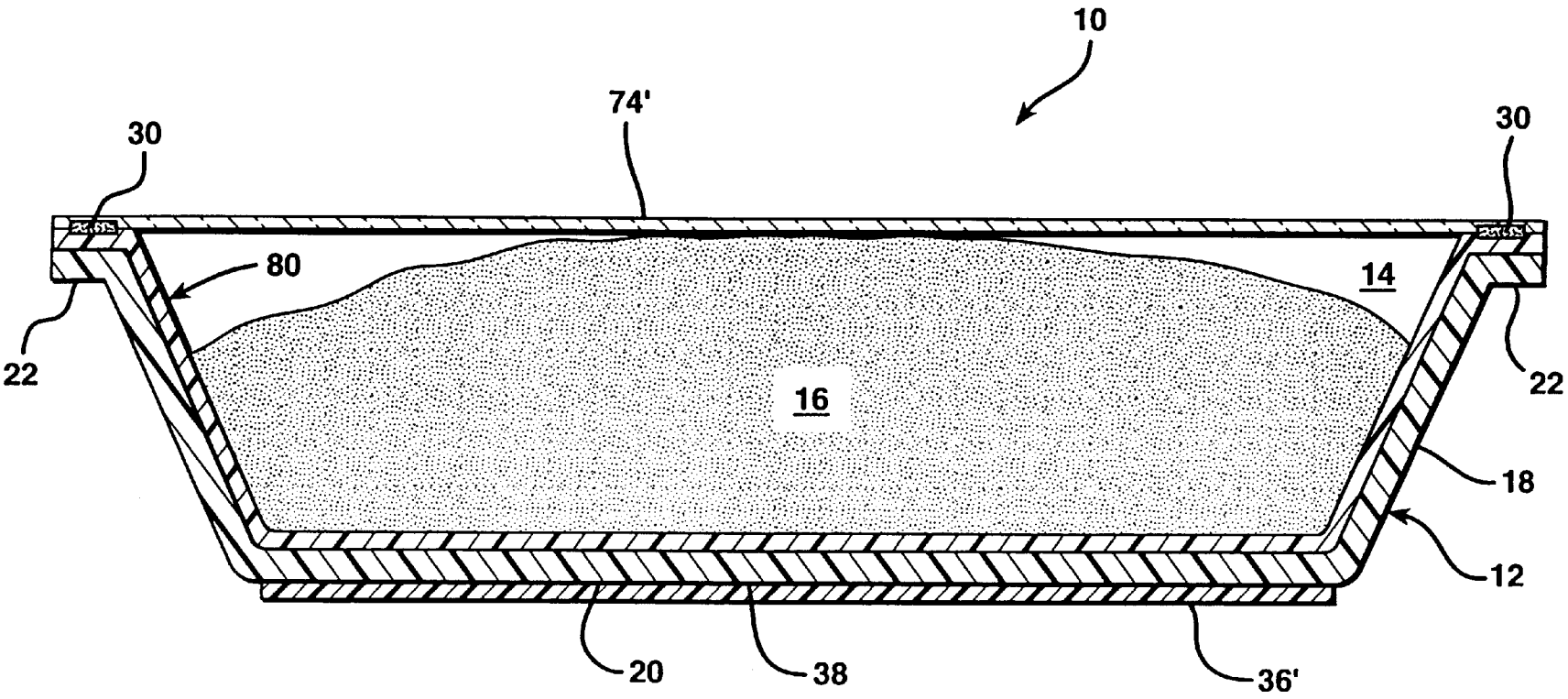
FIG. 8 is a schematic, cross-sectional view the package of FIGS. 6 and 7, wherein the lid has been peelably delaminated such that only a portion of the gas-permeable lid portion remains secured to the product support member.

If desired, the gas-permeable substrate may extend over only a portion of the lower surface 38 of support member 12 as shown in FIGS. 6–8. In this instance, substrate 36' is preferably at least coextensive with base 20 of support member 12 so that, in general, substantially no part of the support member will be in contact with the exposed gas-permeable lid portion of an underlying package in a retail display case stack without an intervening gas-permeable substrate to allow air flow into such underlying package. The substrate may be applied to the support member at any desired point in time, i.e., by laminating the substrate to the support member during the manufacture of the support member; by adhesively applying the substrate to the support member at a central packaging facility either just before or just after the support member is combined with a lid to form a package; or at retail prior to placing the package in a retail display case.

Figure 4:
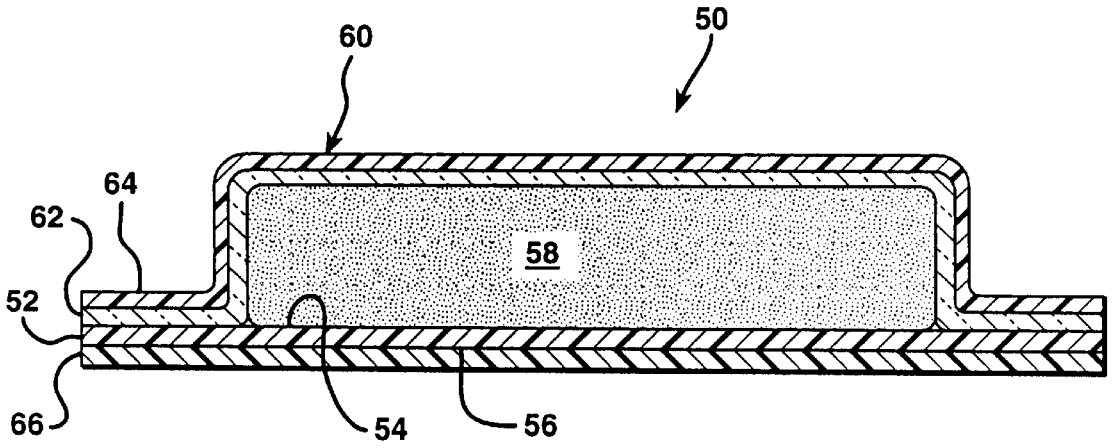
FIG. 4 is a schematic, cross-sectional view of a vacuum skin package in accordance with the present invention.

Referring now to FIG. 4, a vacuum-skin-type case-ready package in accordance with the invention will be described. Vacuum skin package 50 includes a substantially gas-impermeable support member 52 having an upper surface 54 and a lower surface 56 and supporting product 58 on the upper surface 54 thereof. A lid 60 is bonded to the upper surface 54 of support member 52 about the periphery of product 58 to enclose the product between the support member and the lid. Lid 60 includes a gas-permeable portion 62 and a substantially gas-impermeable portion 64. As with modified-atmosphere package 10 described above, gas-impermeable lid portion 64 is peelably removable from gas-permeable lid portion 62 such that the gas-permeable lid portion remains bonded to support member 52 and continues to enclose product 58 following the removal of the gas-impermeable lid portion. As is also the case with package 10, package 50 includes a gas-permeable substrate 66 attached to the lower surface 56 of support member 52, such substrate having at least one principal surface which is non-textured and substantially smooth. Substrate 66 functions in an identical manner in connection with vacuum skin package 60 as does substrate 36 in connection with modified-atmosphere package 10 as described above.

Figure 5:
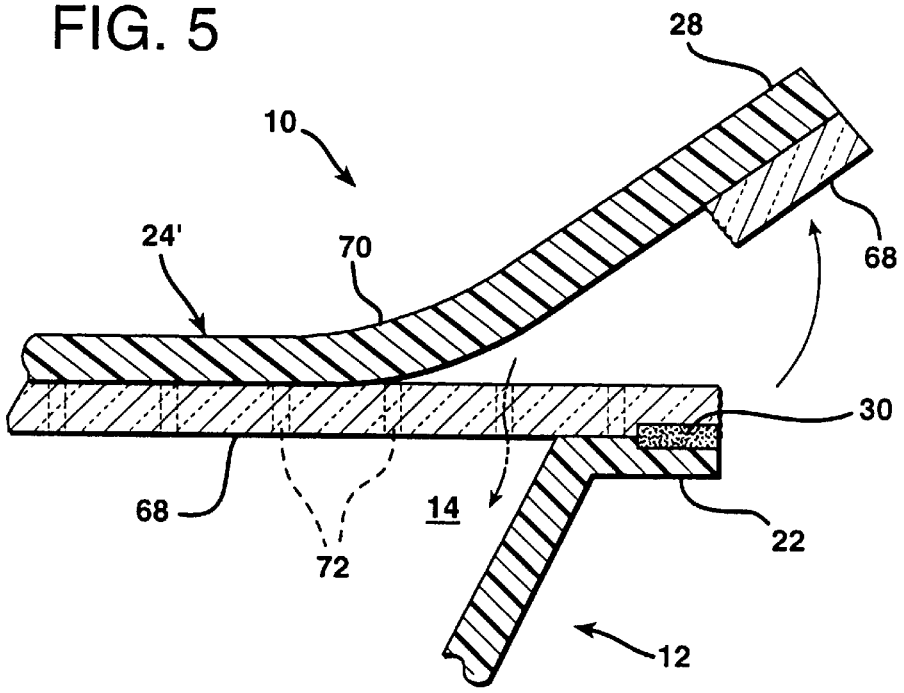
FIG. 5 is a schematic, partial cross-sectional view of the package shown in FIG. 1, wherein the gas-impermeable portion of the lid is being peelably removed from the gas-permeable portion thereof.

Referring now to FIG. 5, one embodiment of a preferred peelable lid for package 10 (or package 50) will be described. In this embodiment, lid 24' comprises a gas-permeable film 68 in contact with and bonded to flange 22 of support member 12, and a substantially gas-impermeable film 70 peelably bonded to gas-permeable film 68. Preferably, at least one of the permeable and impermeable films 68 and 70 comprises a reactively-modified surface in contact with the other film such that lid 24' peelably delaminates at a peel force ranging from about 0.001 to about 2.5 pounds per lineal inch of film width. When the bond strength between films 68 and 70 is such that a peel force ranging from about 0.001 to 2.5 pounds/inch is required to peelably separate them, an optimum balance results between sufficient adhesion to prevent premature separation of film 70 from film 68, e.g. during manufacture, shipping and storage, and sufficient peelability so that film 70 can be separated from film 68 without tearing or otherwise compromising film 68.

As shown, gas-impermeable film 70 is peeled from permeable film 32, preferably by grasping peel tab 28, and pulling in the general direction of the arrow. Heat-seal 30 has sufficient strength to maintain a bond between film 68 and flange 22 during the peeling process, so that film 68 tears upwards at heat-seal 30 until the interface of films 68 and 70 is reached, at which point the peel force propagates along such interface so that film 70 is peelably separated from film 68.

Gas-permeable film 68 preferably includes perforations 72 therein. It is preferred that film 68 is a gas-permeable film because, although the perforations defined therethrough greatly increase the gas transmission rate of the film, the inherent permeability of the film itself aids in gas exchange and facilitates blooming of meat (or poultry) in areas of intimate film-to-meat contact (an impermeable film hinders meat-bloom in areas of intimate film-to-meat contact). However, a non-permeable film which is perforated to render it permeable is also within the scope of the present invention. As is shown in FIG. 5, gas-impermeable film 70 is peeled away to reveal perforated film 68 for a rapid exchange of gases into and out of package 10. In the case where the packaged product is a fresh red meat or poultry product initially packaged in a low-oxygen gas, the peeling and removal of gas-impermeable film 70 allows the low-oxygen gas to escape and atmospheric oxygen to enter the package via perforations 72 (and film 68 itself if inherently gas-permeable), thereby causing the fresh red meat or poultry product to bloom, preferably at retail.

Perforations 72 may have any desired size, e.g., from about 5 to about 500 microns in diameter. Ideally, the perforations are large enough to permit the passage of atmospheric gas therethrough (oxygen, nitrogen, carbon dioxide), but small enough to prevent the passage of liquids or dirt. The perforations may be formed by any suitable means, including the use of mechanical, chemical, or electrical devices. Non-limiting examples of such devices include those which perforate with laser energy, electrostatic discharge, ultrasonic waves, flame discharge, needles or other sharp objects, or combinations thereof.

It is preferred that lid 24' is formed by reactive surface modification of films 68 and/or 70. More preferably, lid 24' is formed by corona lamination. Specifically, when gas-permeable film 68 includes perforations 72, corona lamination (or other form of reactive surface modification) is preferred to either adhesive lamination, wherein the adhesive may occlude the perforations. Most preferably, lamination is accomplished by corona treatment of one or both bonding surfaces of films 68 and 70, followed by joining the films at their bonding surfaces and then applying heat and pressure (e.g., via heated rollers) to the films to thereby complete the bond between the two films. Corona treatment units are commercially available, e.g., from Enercon Industries Corporation of Menomonee Falls, Wis.

Further details concerning the embodiment shown in FIG. 5 are described in U.S. Ser. No. 08/755,991, entitled PACKAGE HAVING A MULTIPLE-FILM LID COMPRISING A GAS-IMPERMEABLE FILM PEELABLY ADHERED TO A GAS-PERMEABLE FILM," filed Nov. 25, 1996, the disclosure of which is hereby incorporated herein by reference thereto.

Referring now to FIGS. 6–8, an alternative peelable lid will be described. FIG. 6 is a schematic, cross-sectional view of package 10, wherein lid 24" comprises a laminate comprising two or more films, at least one of the films being a coextruded, multilayer film, wherein the laminate delaminates within the coextruded, multilayer film when lid 24" is subjected to a peel force ranging from 0.001 to 2.5 pounds per lineal inch of film width. Preferably, lid 24" delaminates into a substantially gas-impermeable portion and a gas-permeable portion.

More specifically, the laminate from which lid 24" is constructed includes two or more films, at least one of the films being a coextruded, multilayer film 74. When the laminate is subjected to a peel force ranging from 0.001 to 2.5 pounds per inch, lid 24" delaminates within coextruded, multilayer film 74. Other films may be included in the laminate as necessary or desired, preferably including a substantially gas-impermeable film 76 comprising an oxygen-barrier material such as, e.g., vinylidene chloride copolymer, polyamide, polyethylene terephthalate, ethylene/vinyl alcohol copolymer, etc. Films 74 and 76 may be bonded by any suitable technique, such as, e.g., adhesive bonding, reactive surface modification, heat treatment, pressure treatment, etc., including combinations thereof. A preferred lamination technique is reactive surface modification and, more preferably, corona treatment combined with pressure and, optionally, heat immediately after corona treatment.

When lid 24" is grasped by, e.g., a retail worker at tab 28 and pulled generally upwards and backwards (i.e., towards an opposite edge or corner of the package), lid 24" delaminates within coextruded, multilayer film 74 as represented by the dashed line 78. Coextruded, multilayer film 74 is preferably a gas-permeable film and/or is perforated to allow atmospheric oxygen to pass therethrough (the same considerations of inherent permeability of the film and perforation size and methods apply to multilayer film 74 as discussed above in relation to gas-permeable film 68). Thus, by delaminating lid 24" within coextruded, multilayer film 74, not only is gas-impermeable film 76 removed from package 10 to thereby allow atmospheric oxygen to enter the package through the remainder of multilayer film 74 (thus allowing a packaged oxygen-sensitive product to be changed in some desirable way, e.g., causing a packaged fresh red meat product to bloom to a bright red color), but the coextruded, multilayer film 74 is reduced in thickness by virtue of being delaminated, thereby increasing the oxygen permeability of that film to allow for more rapid ingress of oxygen into the cavity 14 of the package 10. In certain packaging applications, the increased oxygen permeability of film 74 resulting from its delamination will be sufficient to make unnecessary the perforation of that film.

FIG. 7 illustrates in greater detail the manner in which lid 24" delaminates within coextruded, multilayer film 74 when lid 24" is subjected to a peeling force. Coextruded, multilayer film 74 preferably has an intra-film cohesive strength which is lower than: 1) the inter-film bond-strength between the component films of laminate 24" (i.e., between films 74 and 76); 2) the intra-film cohesive strengths of the other films in the laminate (i.e., film 76 as presently illustrated); and 3) the bond-strength of heat-seal 30. In this manner, the coextruded, multilayer film component of the laminate internally separates, i.e., delaminates, when the laminate is subjected to a peel force which exceeds the intra-film cohesive strength of the coextruded film. Such intra-film cohesive strength preferably ranges from 0.001 to 2.5 pounds per inch.

When a retail worker or other person grasps tab 28 of lid 24" and applies a peeling force thereto in the general direction of the arrow shown in FIG. 74, coextruded, multilayer film 74 begins to delaminate as the peeling force is directed upwards at heat-seal 30 and into plane 78 of relatively weak intra-film cohesive strength in film 74. Delamination plane 78 is preferably formed by the interface of two adjacent layers within multilayer film 74 which peelably separate from one another at a peel force ranging from 0.001 to 2.5 pounds per inch. The inter-layer adhesion between such adjacent layers preferably represents not only the weakest component of the intra-film cohesive strength of coextruded, multilayer film 74, but also the weakest cohesive or adhesive bond within the lid 24". In this fashion, when lid 24" is subjected to a peel force ranging from 0.001 to 2.5 pounds per inch, delamination occurs at plane 78. Peelable separation in this manner may be achieved by constructing coextruded, multilayer film 74 such that one of the adjacent layers at plane 78 comprises a non-polar material while the other adjacent layer comprises a polar material. For example, one of the adjacent layers may comprise non-polar polyethylene homopolymer or copolymer while the other adjacent layer comprises at least one material selected from the group consisting of polyamide, copolyamide, polyester, copolyester such as polyethylene terephthalate, polar polyethylene copolymers such as ethylene/vinyl alcohol, polycarbonate, polymethylpentene, polyvinylidene chloride copolymer, polyurethane, polybutylene homopolymer and copolymer, and polysulfone. Alternatively, one of the adjacent layers at plane 78 may comprise polyethylene homopolymer or copolymer while the other adjacent layer comprises polypropylene homopolymer or copolymer.

As an alternative to providing for inter-layer adhesive separation as a means of achieving delamination within coextruded, multilayer film 74 at plane 78, the coextruded, multilayer film may comprise at least one layer which internally separates when the lid is subjected to a peel force ranging from 0.001 to 2.5 pounds per inch. A combination of inter-layer adhesive failure and intra-layer cohesive failure within coextruded, multilayer film 74 may also be employed, if desired, as a means of achieving preferential delamination of such film. This can occur, e.g., when the primary plane of delamination is between two adjacent film layers but the delamination path "wanders" into one or both of the adjacent film layers.

Preferably, coextruded, multilayer film 74 is perforated. The perforations are preferably formed in coextruded, multilayer film 74 prior to bonding film 74 to gas-impermeable film 76. The perforations preferably extend completely through multilayer film 74 to form a passageway therethrough which extends from one major surface of the film to the other major surface. When the film is delaminated along plane 78, each of the perforations is separated into two portions. One portion is removed from support member along with gas-impermeable film 76, while the other portion remains with package 10 along with the remaining part multilayer film 74 after lid 24" has been delaminated. Delamination thereby exposes the perforations to the atmosphere so that atmospheric oxygen can enter the package therethrough.

The end result of the delamination process is shown in FIG. 8, wherein gas-impermeable film 76 and a portion of coextruded, multilayer film 74 have been removed from package 10 such that only gas-permeable portion 74' of lid 24" remains attached to support member 12. In this manner, product 16 remains fully enclosed within package 10, i.e., gas-permeable portion 74' is still heat-welded to flange 22 of support member 12 via heat-seal 30 and continues to protect the product from microbial and other contaminates. However, atmospheric oxygen can now enter the cavity 14 of package 10 through the now-exposed gas-permeable portion 74', which is gas-permeable by virtue of being formed from a film which is itself gas-permeable and/or having perforations therein.

Another feature of the invention is shown in FIGS. 6–8, wherein support member 12 preferably includes a sealant film 80 having an upper principal surface 82 and a lower principal surface 84. The lower surface 84 is bonded to cavity 14 and to the upper surface of flange 22. In this manner, the upper surface 82 of sealant film 80 defines the uppermost surface of support member 12 which is thereby in direct contact with product 16 in cavity 14 and in contact with coextruded, multilayer film 74 of lid 24" on the upper surface of flange 22. More specifically, coextruded, multilayer film 74 is actually bonded, via heat-seal 30, to the upper surface 82 of sealant film 80 at flange 22. Thus, it is preferred that sealant film 80 fully lines, i.e., is conformably bonded to, the entire upper surface of support member 12.

Although it is not required for support member 12 to include a sealant film in this or any embodiment of the present invention, it is preferable to include such a sealant film as a liner for at least the upper surface of support member 12 as a means to improve the functional characteristics of the support member when such improvement is deemed necessary or desirable. For example, if the support member is constructed of a material which is not sufficiently gas-impermeable for the intended packaging application, a sealant film which provides the required degree of gas-impermeability may be employed (i.e., a "barrier/sealant film"). A sealant film may also be used to improve the bond-strength of the heat-seal 30, i.e., when the lid and support member are constructed of materials which are not readily capable of forming a sufficiently strong heat-seal, a sealant film may be used which both bonds well to the upper surface of the support member and also forms a strong heat-seal with the coextruded, multilayer film.

For most packaging applications, both gas-impermeable film 76 and sealant film 80 preferably comprise a material which provides a substantial barrier to the passage of gas, particularly oxygen, therethrough. Suitable materials include, e.g., vinylidene chloride copolymer (saran), nylon, polyethylene terephthalate, ethylene/vinyl alcohol copolymer, silicon oxides (SiOx), etc.

Each of films 74, 76, and 80 may have any desired thickness, ranging, e.g., from about 0.3 mils to about 12 mils. Preferably, the films range in thickness from about 0.5 mils to about 8 mils; more preferably from about 0.75 mils to about 5 mils; most preferably from about 1 to about 3 mils.

Further details concerning the embodiment of the invention described immediately above and shown in FIGS. 6–8 are disclosed in co-pending patent application Ser. No. 08/764,405, entitled "LAMINATE HAVING A COEXTRUDED, MULTILAYER FILM WHICH DELAMINATES AND PACKAGE MADE THEREFROM and filed Dec. 11, 1996, the disclosure of which is hereby incorporated herein by reference thereto.

As a further peelable lidding mechanism which may be employed, the gas-permeable and gas-impermeable portions of lid 24 may be separate films which are bonded to support member 12 at separate locations, e.g., at separate locations on flange 22. Such a lidding arrangement is disclosed in, e.g., the above-referenced U.S. Pat. Nos. 5,348,752 and 5,439,132.

Figure 9:
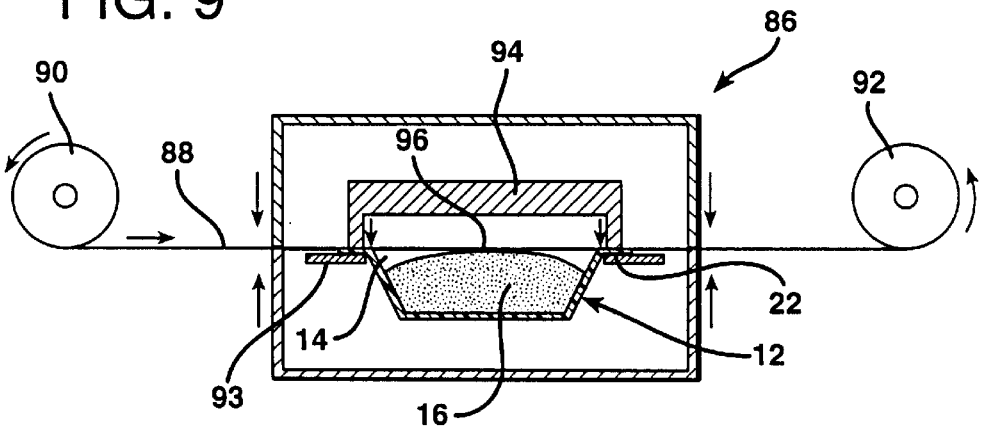
FIG. 9 is a schematic illustration of a packaging apparatus for producing a package in accordance with the present invention, wherein a securing device forms a heat-seal between a web and the flange of a support member in an enclosure formed by upper and lower vacuum chamber portions.
Figure 10:
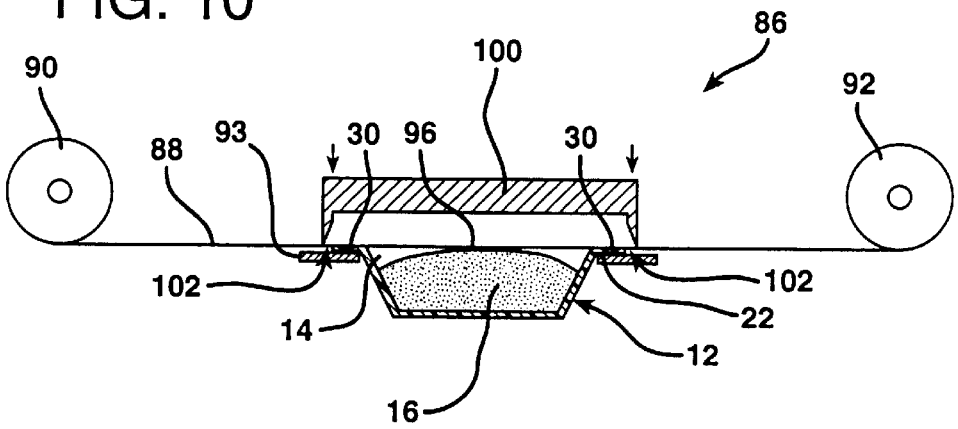
FIG. 10 is similar to FIG. 9, except that a cutting element is severing a segment of the web to form a lid on the support member.
Figure 11:
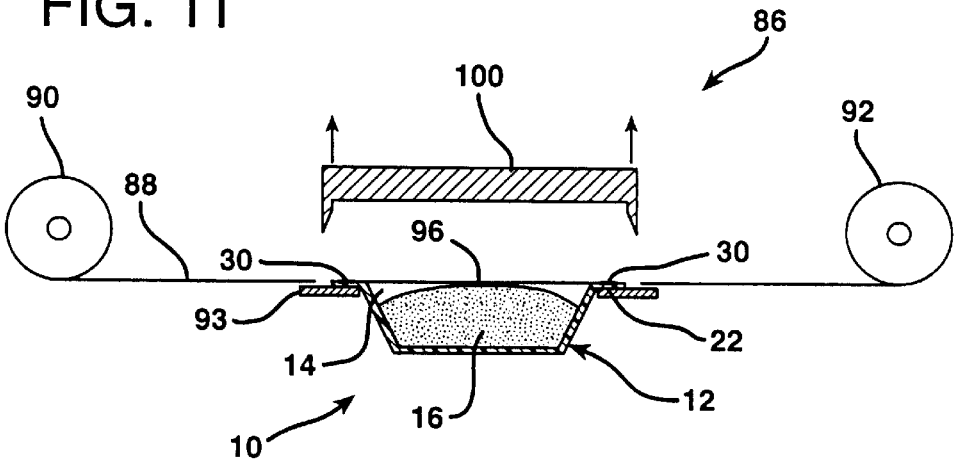
FIG. 11 is similar to FIG. 10, except that the cutting element has retracted so that the finished package can be removed from the packaging apparatus.

Referring now to FIGS. 9–11, a preferred method and apparatus for producing modified-atmosphere packages in accordance with the invention will be described. Methods for making vacuum skin packages are described in the above-referenced U.S. Pat. Nos. Re 30,009 and 5,346,735.

As illustrated, packaging apparatus 86 includes a mechanism for positioning a web of film 88 over support member 12 having product 16 disposed therein. The positioning mechanism preferably includes a pair of rolls 90 and 92 which unwind and take-up, respectively, web 88 and position the web over support member 12 so that a lid can be severed from the web and heat-sealed to the support member. The material from which web 88 is formed is preferably a flexible, polymeric film. One or more of such webs may be applied sequentially or simultaneously to support member 12 to form lid 24 as described above. For simplicity, only one web is illustrated. Apparatus 86 also includes a carrier 93 for supporting and carrying product-loaded support member 12 throughout the packaging process.

Referring specifically to FIG. 9, apparatus 86 further includes a device 94 for securing a portion 96 of web 88 to the flange 22 of support member 12 by forming a heat-seal (i.e., heat-seal 30 as described above) between the support member and web. The heat-seal formed by securing device 94 preferably extends substantially continuously about the upper surface of flange 22 to enclose product 16 between support member 12 and the secured portion 96 of web 88. Securing device 94 applies heat and pressure to web 88 at flange 22 in the direction of the arrows shown in FIG. 9 to thereby effect a heat-seal between the web and flange. The amount of heat and pressure which are necessary to effect the heat-seal are dependent upon a number of factors, e.g., the thickness and composition of web 88, and can readily be determined by one having ordinary skill in the art to which this invention pertains. Securing device 94 preferably has a heated metal surface to contact web 88. Preferably, the heated metal surface essentially mirrors the shape of, but has a slightly narrower width than, flange 22.

It is preferred that, prior to securing web 88 to flange 22, cavity 14 is at least partially evacuated of air and then at least partially filled with a desired packaging gas, e.g., one which is lower in oxygen content than air. This may be accomplished by carrying out the securing step shown in FIG. 9 in a substantially air-tight enclosure which can be evacuated and/or back-flushed with a desired packaging gas. Such air-tight enclosure may be formed from upper and lower vacuum chamber portions 98 and 99, at least one of which is movable in the direction of the arrows so that the chamber portions can be joined to enclose the entire packaging apparatus 86 (or only a portion thereof excluding rolls 90 and 92 as shown). The resultant enclosure is then evacuated to a desired degree and, if desired, filled ("back-flushed") with a preservation-enhancing packaging gas. Portion 96 of web 88 is then secured to support member 12 so that cavity 14 will contain therein the preservation-enhancing packaging gas (along with product 16). In this manner, food product 16 can be shipped and stored in an atmosphere which is ideally suited to maximize the shelf-life of that particular product. Movable vacuum chamber portions and associated evacuation/back-flushing apparatus (not shown) are well known in the art.

Any desired amount of air may be removed from the enclosure formed by chamber portions 98 and 99 during the evacuation step, e.g., ranging from 1% to 99.999% by volume. In the case where a fresh red meat product is to be packaged, the amount of air removed preferably ranges from about 99% to about 99.999%, and more preferably from about 99.5% to about 99.999% by volume. Preferred gases to replace the evacuated air include, e.g., carbon dioxide, nitrogen, argon, etc., and mixtures of such gases. As a result of these steps, the cavity 14 of package 10 will preferably contain, prior to peeling lid 24, less than 1% oxygen by volume, more preferably less than 0.5% oxygen, even more preferably less than 0.1% oxygen, and most preferably, less than 0.05% oxygen by volume, with the balance comprising a gas or mixture of gases, such as a mixture of carbon dioxide and nitrogen. When package 10 provides a substantially gas-impermeable enclosure, such a modified-atmosphere packaging environment ensures that a packaged fresh red meat product will have a shelf-life of at least seven days, more preferably at least ten days, even more preferably at least fourteen days and, most preferably, at least twenty one days (assuming, of course, that the package is maintained under refrigerated conditions, e.g., at temperatures ranging from about 28° F. to about 48° F., and not exposed to light for any appreciable amount of time).

Referring now to FIG. 10, packaging apparatus 86 preferably further includes an apparatus 100 for severing a segment 102 of web 88 in a substantially closed geometrical shape that encompasses the secured portion 96 of the web. Severing apparatus 100 preferably includes a cutting element which severs web 88 by applying thereto mechanical force (e.g., from a sharpened or serrated blade), heat, or a combination thereof.

As illustrated sequentially in FIGS. 9–11, a preferred packaging method is as follows. After product 16 has been loaded into support member 12, rolls 90 and 92 position web 88 over support member 12 as shown in FIG. 9. Upper and lower vacuum chamber portions 98 and 99 then converge on opposite surfaces of web 88 to form a substantially air-tight enclosure, which enclosure is then evacuated and then back-flushed with a desired packaging gas. Securing device 94 then secures portion 96 of web 88 to flange 22 of support member 12. This is shown in FIG. 9 wherein securing device 94, which is reciprocatable toward and away from web 88, translates towards the web and is pressed into contact with the upper surface of the web over flange 22 to thereby heat-seal the web to flange 22. In so doing, product 16 is enclosed between support member 12 and the secured portion 96 of web 88.

The next step in the preferred method is shown in FIG. 10, wherein after securing device 94 has formed heat-seal 30, upper and lower vacuum chamber portions 98, 99 have separated and securing device 94 has disengaged from portion 96 of web 88. Thereafter, severing apparatus 100, which is reciprocatable toward and away from web 88, translates towards the web and severs segment 102 therefrom in a closed geometrical shape that encompasses the secured portion 96. Any desired geometrical shape is possible, but is preferably one which follows, but is slightly outside of, the periphery of flange 22 so that the shape of the severed web segment 102 is similar to but slightly larger than the shape defined by the periphery of flange 22. Web 88 is preferably formed from a film which is at least partially heat-shrinkable and severing apparatus 100 is preferably heated to both facilitate the severing of the web and to cause a majority of the periphery of the severed web segment 102 to heat-shrink toward heat-seal 30, thereby producing a neat, aesthetically-appealing package.

The finished package 10 is shown in FIG. 11, wherein cutting element 66 has disengaged from web 88 by reciprocating away from the web as shown. The severed and heat-contracted web segment 102 (encompassing secured portion 96) becomes the lid (i.e., lid 24) for the package. Package 10 is then moved from packaging apparatus 86 either manually or automatically (e.g., via a conveyor belt).

The aforementioned packaging method is preferably a continuous process, with one product-containing support member after another having a peelable lid applied thereto in the manner described above. The process may also be performed in parallel, with two or more packages being produced simultaneously. In a continuous process, rolls 90 and 92 intermittently unwind and take-up, respectively, web 88 between each lidding cycle as described above to continuously present a new section of web from which a portion may be secured and severed. Preferably, web segment 102 is severed from web 88 in such a manner that the web remains sufficiently intact to allow take-up roll 92 to advance the web from unwind roll 90. This may be accomplished by severing web segments 102 from the interior of the web so that the edges thereof remain intact.

The aforedescribed packaging method can be performed on currently available modified-atmosphere packaging machinery commercially supplied by, e.g., Ross Industries, Inc. or Multivac, Inc. Specific examples of suitable models include the Ross IN-PACK® 3320 or the Multivac® T500.

Figure 12:
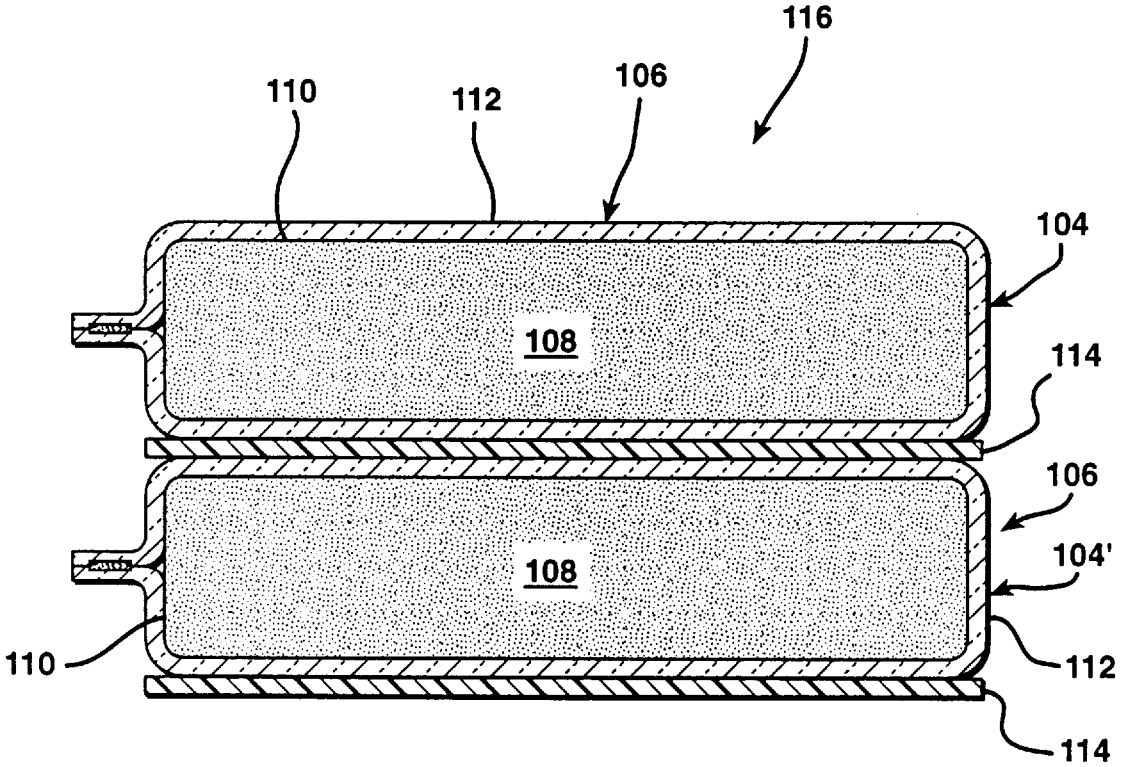
FIG. 12 is cross-sectional view of another embodiment of the invention, wherein a pair of packages are stacked one on top of the other, the packages including a gas-permeable bag enclosing a product therewithin and a gas-permeable substrate on the bottom surfaces thereof.

In accordance with another embodiment of the invention as shown in FIG. 12, a case-ready package 104 includes a bag 106 comprising a gas-permeable thermoplastic film and enclosing a product 108 therewithin. Bag 106 has an interior surface 110 in contact with product 108 and an exterior surface 112. A gas-permeable substrate 114, which is identical to gas-permeable substrate 36 as described above, is attached to at least a portion of exterior surface 112 of bag 106. Either all or a portion of the exterior surface of bag 106 may be covered by a gas-permeable substrate. As shown, only the bottom surface of bag 106 has attached thereto a gas-permeable substrate.

For reasons which have been previously explained, gas-permeable substrate 114 is particularly advantageous when package 104 is an upper package in a stack 116 and disposed on top of a lower, identical package 104', and when gas-permeable substrate 114 is positioned between the upper and lower packages 104 and 104', respectively, in the stack. Although bag 106 is formed from a thermoplastic film which is gas-permeable, it has been found that this alone is not sufficient to prevent discoloration due to insufficient oxygen flow to product 108 packaged in lower package 104'. It is theorized that this is due to the intimate product-to-film contact in the lower area of bag 106 on which product 108 rests, i.e., is urged by force of gravity. The addition of gas-permeable substrate 114 as shown has been found to allow sufficient air flow between the packages that product 108 in lower package 104' remains in a state of bloom and without discoloration due to oxygen deprivation. These findings also apply to modified-atmosphere or vacuum-skin packages as described above, wherein the support members thereof may be rendered gas-permeable by the removal from such support members of a gas-impermeable outer film or film portion (see, e.g., Example 1 below).

Preferably, bag 106 is formed from a heat-shrinkable thermoplastic film and is heat-shrunk about product 108 to conform to the shape of the product as shown in FIG. 12. Alternatively, the inside of bag 106 may be evacuated after product 108 is loaded therein in order to produce the conforming package as shown. A combination of heat-shrink and evacuation may also be employed. If desired, neither technique may be used and product 108 may be non-conformally, i.e., loosely, enclosed with a gas-permeable bag.

Prior to being stacked as shown, e.g., in a retail display case, one or more packages 104 may be enclosed in an outer bag (not shown) formed from a substantially gas-impermeable thermoplastic film in order to minimize or prevent oxygen contact with product 108 during shipping and storage until it is desired to place the package in a retail display case, at which time the package(s) 104 would be removed from the outer bag so that product(s) 108 are allowed to bloom in the presence of atmospheric oxygen (which enters the packages via the gas-permeable film from which bags 106 are formed). Preferably, a gas which enhances the preservation of product 108, e.g., a gas which has a low oxygen content as discussed above, is also enclosed in the gas-impermeable outer bag. Such preservation-enhancing gas within the outer bag preserves the packaged product by permeating the gas-permeable inner bag, i.e., bag 106, during shipping and storage.

The invention may be further understood by reference to the following examples, which are provided for the purpose of representation, and are not to be construed as limiting the scope of the invention.

EXAMPLES

Example 1

Vacuum skin packages of fresh red meat (top round beef) were made as described above with a Multivac® R7000 packaging machine. Both the support member and lid had the following structure:

Layers: 1'/2'/3'//1/2/3/4/5/6 where:

- Layer 1'=Narrow molecular weight distribution polyethylene (food contact/heat-seal layer)
- Layer 2'=ethylene/butyl acrylate
- Layer 3'=blend of propylene/ethylene copolymer+anhydride-grafted polypropylene
- Layer 1=ethylene/vinyl alcohol (44 mol % ethylene)
- Layer 2=ethylene/vinyl acetate
- Layer 3=same as layer 1
- Layer 4=same as layer 2
- Layer 5=ionomer
- Layer 6=high density polyethylene (outer/abuse-resistant layer)

Layers 1–6 comprised the gas-impermeable portion of the film while layers 1'–3' comprised the gas-permeable portion of the film, with "//" designating the peel interface between the two film portions.

The gas-impermeable lid portions of all packages were then peelably removed. Three of the packages also had the gas-impermeable portion of the support members peelably removed so that the entire package was gas-permeable. Strips of TYVEK® spun-bonded, non-woven polyolefin fibrous sheet material were then attached to the lower surface of the non-thermoformed support members of each of the packages such that only a portion of the lower support member surface was covered with the TYVEK substrate. The packages were then arranged into two stacks of three packages and placed in a refrigerated retail display case, with one stack having the gas-impermeable portion of the support members still in place and the other stack having such portion removed from the support members.

After being stacked in the display case for three days, the packages were removed and visually inspected for discoloration due to oxygen deprivation. The meat contained in the top-most package in each of the stacks had no discoloration as expected due to unimpeded oxygen access to the packaged meat. However, the two underlying packages in the stacks both exhibited premature brown discoloration (metmyoglobin) in the surface areas of the meat wherein no TYVEK substrate was located between the gas-permeable lid and the support member of the overlying package. In contrast, the surface areas of the meat adjacent to an overlying TYVEK strip still exhibited a red (oxymyoglobin) color which consumers associate with freshness. Thus, the TYVEK substrate was effective in allowing oxygen to flow into the underlying packages in the stack. Interestingly, even those packages wherein the gas-impermeable portion was removed from the support member caused discoloration in the packaged meat in underlying packages in those areas where a TYVEK substrate was not located. This indicates that, even though the gas-impermeable support member portion of the overlying packages had been removed, the remaining portion of the support member did not permit sufficient oxygen flow into the underlying package to prevent discoloration without an additional gas-permeable substrate attached to the lower surface of the support member in accordance with present invention.

Comparative Example 1

Vacuum skin packages were made as in Example 1 except that a Multivac® CD 6000 packaging machine was used to form the packages and the support member included an outer (lower) film of polyvinyl chloride having a textured bottom surface which was created by a thermoforming die in the packaging machine during the packaging operation. The textured surface resembled an array of square, truncated pyramids. After a period of storage, the gas-impermeable lid portions of all packages were peelably removed and the packages were stacked in retail display cases. In approximately 80% of the underlying packages in the stacks, the following events were observed:

after approximately one day in the display case, indentations corresponding to the textured bottom surface of overlying packages formed on the upper surface of the packaged meat products in the underlying packages; and after approximately two days in the display case, premature metmyoglobin discoloration appeared in the indented areas on the surface of the meat products.

In general, discoloration worsened with increasing weight of overlying packages in the stack, i.e., with increasing weight and/or number of overlying packages. Also, certain cuts of meat, such as top sirloin, were observed to be more sensitive to premature discoloration when placed in a stacked arrangement than other cuts of meat, such as ribeye steak.

Example 2

Ground chuck was placed in "barrier foam" trays. Such trays were thermoformed from a three-layer laminate consisting of a barrier/sealant liner film containing ethylene/vinyl alcohol copolymer on the upper surface of the tray, an expanded polystyrene core layer, and an oriented polystyrene (OPS) film forming a coextensive gas-permeable substrate on the lower surface of the tray. The trays were made into modified-atmosphere packages as described above using a Ross IN-PACK™ packaging machine which lidded the trays with a delaminatable film as described above in connection with FIGS. 6–8.

After peeling the gas-impermeable lid portion from the packages, they were arranged in stacks of two packages, placed in a retail case, and evaluated for discoloration at 6 and 22 hours. After 6 hours, the packaged meat in the underlying packages exhibited trace discoloration (probably pressure related). After 22 hours, the appearance of the meat packaged in the underlying packages was very similar with about 3–10% discoloration. The meat in all of the top packages was brown by this point indicating that the meat was at the end of its shelf-life (meat contained in the top packages in a stack normally discolors first since that meat is exposed to more light and meat color is light sensitive.)

A similar test was performed which compared modified-atmosphere packages having expanded polystyrene trays both with and without a coextensive OPS film on the lower surface of the tray. Both sets of packages exhibited similar results, i.e., little or no premature discoloration when placed in a stack. This was surprising in that a porous surface such as a foamed polystyrene surface would be expected to allow for greater air flow thereunder than a smooth, non-porous surface such as an oriented polystyrene film, and thereby result in less premature discoloration in underlying packages than similar packages having an outer OPS substrate. When using a foamed support member, it is highly advantageous to employ a non-foamed film on the outer surface thereof because such a film adds strength to the support member. This is particularly critical when packaging relatively dense products such as fresh meat or poultry. In accordance with the present invention, then, a gas-permeable substrate such as OPS film can be attached to the outer (lower) surface of a support member to provide additional strength to the support member without causing meat or poultry products packaged in underlying packages to discolor prematurely due to oxygen deprivation.

While the invention has been described with reference to illustrative examples, those skilled in the art will understand that various modifications may be made to the invention as described without departing from the scope of the claims which follow.

What is claimed is:

1. A package, comprising:

a. a substantially gas-impermeable support member having an upper surface and a lower surface and supporting a product on the upper surface thereof;

b. a lid bonded to the upper surface of said support member about the periphery of the product to enclose the product between said support member and said lid, said lid comprising a gas-permeable portion and a substantially gas-impermeable portion, said substantially gas-impermeable portion being peelably removable from said gas-permeable portion such that said gas-permeable portion remains bonded to said support member and continues to enclose the product following removal of said substantially gas-impermeable portion, said lid further including a mechanism to initiate peeling of said gas-impermeable portion from said gas-permeable portion; and c. a gas-permeable substrate attached to the lower surface of said support member, said substrate having at least one principal surface which is non-textured and substantially smooth.

2. The package of claim 1, wherein said gas-permeable substrate attached to the lower surface of said support member is selected from the group consisting of polystyrene film and woven or non-woven fibrous sheet material.

3. The package of claim 2, wherein said gas-permeable substrate is selected from the group consisting of oriented polystyrene film, high impact polystyrene film, and polyolefin fibrous sheet materials.

4. The package of claim 1, wherein said gas-permeable substrate attached to the lower surface of said support member has a gas transmission rate of at least about 5,000 $cc/m^2/24$ hrs./atm. at 73° F.

5. The package of claim 1, wherein said gas-permeable substrate attached to the lower surface of said support member is coextensive with the lower surface of said support member.

6. The package of claim 1, wherein said gas-permeable substrate attached to the lower surface of said support member extends over a portion of the lower surface of said support member.

7. The package of claim 1, wherein said product is a fresh meat or fresh poultry product.

8. The package of claim 1, wherein said lid comprises a gas-permeable film bonded to said support member and a substantially gas-impermeable film bonded to said gas-permeable film, at least one of said permeable and impermeable films comprising a reactively-modified surface in contact with the other film such that said lid peelably delaminates at a peel force ranging from 0.001 pounds per inch to 2.5 pounds per inch.

9. The package of claim 1, wherein said lid comprises a laminate comprising two or more films, at least one of said films being a coextruded, multilayer film, wherein said laminate delaminates within said coextruded, multilayer film when said laminate is subjected to a peel force ranging from 0.001 to 2.5 pounds per inch.

10. The package of claim 1, wherein said gas-permeable and gas-impermeable portions of said lid are bonded to said support member at separate locations.

11. A method of reducing discoloration in meat or poultry products enclosed within packages when said packages are disposed in a stack of two or more packages, the method comprising:

a. providing at least a first package and a second package, each of said first and second packages comprising
   1) a substantially gas-impermeable support member having an upper surface and a lower surface and supporting a product on the upper surface thereof;
   2) a lid bonded to the upper surface of said support member about the periphery of the product to enclose the product between said support member and said lid, said lid comprising a gas-permeable film, and
   3) a gas-permeable substrate attached to the lower surface of said support member, said substrate having at least one principal surface which is non-textured and substantially smooth; and b. stacking said first package on top of said second package such that the support member of said first package is in contact with the gas-permeable lid of said second package, said gas-permeable substrate attached to the lower support member surface of said first package being positioned between said lower support member surface of said first package and the upper surface of the gas-permeable lid of said second package.

12. The method of claim 11, wherein said gas-permeable substrate attached to the lower surface of said support member is sufficiently gas-permeable that air can flow into said second package via said gas-permeable substrate attached to the lower support member surface of said first package and the gas-permeable lid of said second package.

13. The method of claim 11, wherein said gas-permeable substrate attached to the lower surface of said support member is selected from the group consisting of oriented polystyrene and non-woven fibrous sheet material.

14. The method of claim 13, wherein said non-woven fibrous sheet material comprises non-woven polymer fibers selected from the group consisting of polyolefins and polyesters.

15. The method of claim 11, wherein said gas-permeable substrate attached to the lower surface of said support member has a gas transmission rate of at least about 5,000 $cc/m^2/24$ hrs./atm. at 73° F.

16. The method of claim 11, wherein said gas-permeable substrate attached to the lower surface of said support member is coextensive with the lower surface of said support member.

17. The method of claim 11, wherein said gas-permeable substrate attached to the lower surface of said support member extends over a portion of the lower surface of said support member.

18. The method of claim 11, wherein said product is a fresh meat or fresh poultry product.

19. A stack of two or more packages comprising at least a first package stacked on top of a second package, each of said packages comprising:

a) a substantially gas-impermeable support member having an upper surface and a lower surface and supporting a product on the upper surface thereof;

b) a lid bonded to the upper surface of said support member about the periphery of the product to enclose the product between said support member and said lid, said lid initially comprising a gas-permeable portion peelably bonded to a substantially gas-impermeable portion and including a mechanism to initiate peeling of said gas-impermeable portion from said gas-permeable portion, said substantially gas-impermeable portion having been removed from said gas-permeable portion such that said gas-permeable portion remains bonded to said support member and continues to enclose the product; and c) a gas-permeable substrate attached to the lower surface of said support member, said substrate having at least one principal surface which is non-textured and substantially smooth, whereby, the support member of said first package is in contact with the gas-permeable lid portion of said second package, said gas-permeable substrate attached to the lower support member surface of said first package being positioned between the support member of said first package and the gas-permeable lid portion of said second package so that air can flow into said second package via the gas-permeable substrate of said first package and the gas-permeable lid portion of ad second package.

* * * * *